US009966662B2

(12) United States Patent
Leung et al.

(10) Patent No.: US 9,966,662 B2
(45) Date of Patent: May 8, 2018

(54) ANTENNA

(71) Applicant: City University of Hong Kong, Kowloon (HK)

(72) Inventors: Kwok Wa Leung, Kowloon Tong (HK); Li Ying Feng, Kowloon Tong (HK)

(73) Assignee: CITY UNIVERSITY OF HONG KONG, Kowloon (HK)

( * ) Notice: Subject to any disclaimer, the term of this patent is extended or adjusted under 35 U.S.C. 154(b) by 142 days.

(21) Appl. No.: 14/870,686

(22) Filed: Sep. 30, 2015

(65) Prior Publication Data

US 2017/0093039 A1 Mar. 30, 2017

(51) Int. Cl.

| | |
|---|---|
| ***H01Q 1/36*** | (2006.01) |
| ***H01Q 5/10*** | (2015.01) |
| ***H01Q 13/00*** | (2006.01) |
| ***H01Q 1/48*** | (2006.01) |

(52) U.S. Cl.

CPC ..... *H01Q 5/10* (2015.01); *H01Q 1/36* (2013.01); *H01Q 1/48* (2013.01); *H01Q 13/00* (2013.01)

(58) Field of Classification Search

CPC ..... H01Q 5/10; H01Q 1/36; H01Q 13/00

USPC ..... 343/702, 846

See application file for complete search history.

(56) References Cited

U.S. PATENT DOCUMENTS

| | | | | |
|---|---|---|---|---|
| 4,207,573 | A | 6/1980 | Vignier | |
| 4,347,517 | A * | 8/1982 | Kaloi | H01Q 9/0414 343/700 MS |
| 5,255,003 | A | 10/1993 | Mitchell | |
| 5,835,057 | A | 11/1998 | van Heyningen | |
| 6,549,169 | B1 * | 4/2003 | Matsuyoshi | H01Q 1/243 343/702 |
| 6,600,455 | B2 | 7/2003 | Yamamoto | |
| 6,950,076 | B2 | 9/2005 | Holly | |
| 7,079,079 | B2 * | 7/2006 | Jo | H01Q 1/243 343/700 MS |
| 7,764,233 | B2 * | 7/2010 | Wu | H01Q 1/243 343/700 MS |
| 9,843,099 | B2 * | 12/2017 | Legay | H01Q 13/00 |
| 2002/0140612 | A1 * | 10/2002 | Kadambi | H01Q 9/0421 343/702 |
| 2014/0132473 | A1 * | 5/2014 | Isom | H01Q 1/38 343/855 |

OTHER PUBLICATIONS

T. Smith, U. Gothelf, O. S. Kim, and O. Breinbjerg, "An FSS-backed 20/30 GHz circularly polarized reflectarray for a shared aperture L- and Ka-band satellite communication antenna," IEEE Trans. Antennas Propag., vol. 62, No. 2, pp. 661-668, Feb. 2014.

(Continued)

*Primary Examiner* — Dameon E Levi
*Assistant Examiner* — Hasan Islam
(74) *Attorney, Agent, or Firm* — George A. Leone; Citadel Patent Law

(57) ABSTRACT

An antenna for use in a communication system with a number of plates connected to a ground plane, where when the number of plates are excited by at least two electrical signals, the number of plates are arranged to radiate at least two electromagnetic signals each having an independent resonant frequency.

22 Claims, 8 Drawing Sheets

(56) References Cited

OTHER PUBLICATIONS

L. Zhang, K. Y. See, B. Zhang, and Y. P. Zhang, "Integration of dual-band monopole and microstrip grid array for single-chip tri-band application," IEEE Trans. Antennas Propag., vol. 61, No. 1, pp. 439-443, Jan. 2013.
Z. H. Tu, Y. P. Zhang, C. Luxey, A. Bisognin, D. Titz, and F. Ferrero, "A ceramic antenna for tri-band radio devices," IEEE Trans. Antennas Propag., vol. 61, No. 11, pp. 5776-5780, Nov. 2013.
X. Qu, S. S. Zhong, Y. M. Zhang, and W. Wang, "Design of an S/X dual-band dual-polarised microstrip antenna array for SAR applications," IET Microw. Antennas Propag., vol. 1, No. 2, pp. 513-517, 2007.
D. M. Polar and D. D. Targonski, "A shared-aperture dual-band dual-polarized microstrip array," IEEE Trans. Antennas Propag., vol. 49, No. 2, pp. 150-157, 2001.
S. G. Zhou, P. K. Tan and T. H. Chio, "Wideband, low profile P- and Ku-band shared aperture antenna with high isolation and low cross-polarisation," IET Microw. Antennas Propag., vol. 7, No. 4, pp. 223-229, 2013.
C. Han, C. Rodenbeck, J. Huang, and K Chang, "A C/Ka dual-frequency dual-layer circularly polarized reflectarray antenna with microstrip ring elements," IEEE Trans. Antennas Propag., vol. 52, pp. 2871-2876, Nov. 2004.
W. Menzel, M. Al-Tikriti and M. B. E. Lopes, "Common aperture, dual frequency printed antenna (900MHz and 60 Hz)," Electron. Lett., vol. 37, No. 17, pp. 1059-1060, 2001.

* cited by examiner

ANTENNA

TECHNICAL FIELD

The present invention relates to an antenna for use in a communication system, although not exclusively, to a parallel-plate antenna adapted to operates at two frequencies in a communication system.

BACKGROUND

In a radio signal communication system, information is transformed to radio signal for transmitting in form of an electromagnetic wave or radiation. These electromagnetic signals are further transmitted and/or received by suitable antennas.

In general, antennas are designed to work in particular frequency or frequency range. In some communication systems, the signal generators may generate electrical signals of multiple frequencies. Accordingly, multiple antennas operating in different operation frequencies or frequency ranges may be used to transmit and/or receive electromagnetic signals in different frequencies.

SUMMARY OF THE INVENTION

In accordance with a first aspect of the present invention, there is provided an antenna for use in a communication system comprising: a plurality of plates connected to a ground plane, wherein when the plurality of plates are excited by at least two electrical signals, the plurality of plates are arranged to radiate at least two electromagnetic signals each having an independent resonant frequency.

In an embodiment of the first aspect, each of the plurality of plates is parallel to each other.

In an embodiment of the first aspect, the plurality of plates includes a plurality of folded plates.

In an embodiment of the first aspect, each of the plurality of folded plates includes a plurality of plate portions, wherein each of the plurality of plate portions is parallel to each other.

In an embodiment of the first aspect, the plurality of folded plates are positioned on the ground plane in a back-to-back configuration.

In an embodiment of the first aspect, the plurality of plates includes a plurality of straight plates.

In an embodiment of the first aspect, the plurality of plates are positioned on the ground plane with a predetermined separation between each pair of the plurality of plates.

In an embodiment of the first aspect, a first resonant frequency of one of the at least two electromagnetic signals is determined by the predetermined separation.

In an embodiment of the first aspect, further comprising a probe feeder arranged to feed the plurality of plates.

In an embodiment of the first aspect, the probe feeder is in an L-shape and includes a vertical portion connected to a horizontal portion.

In an embodiment of the first aspect, the probe feeder is positioned between a pair of the plurality of plates.

In an embodiment of the first aspect, further comprising a half-ring sleeve coupled to the probe feeder.

In an embodiment of the first aspect, the half-ring sleeve is arranged to suppress a crosspolarized field within the plurality of plates.

In an embodiment of the first aspect, further comprising a plurality of ridges positioned at the sides of the plurality of plates.

In an embodiment of the first aspect, the plurality of ridges are arranged to suppress a side lobe of one of the at least two electromagnetic signals radiating from the Fabry-Perot resonator antenna.

In an embodiment of the first aspect, the combination of the plurality of plates, the ground plane and the probe feeder is arranged to operate as a Fabry-Perot resonator antenna.

In an embodiment of the first aspect, the Fabry-Perot resonator antenna is arranged to operate in a millimeter-wave frequency range.

In an embodiment of the first aspect, further comprising a strip feedline arranged to feed the plurality of plates.

In an embodiment of the first aspect, the strip feedline is in a hook-shape and includes a horizontal arm portion and an open stub portion.

In an embodiment of the first aspect, the strip feedline traverses across the thickness of at least two of the plurality of plates and a distance between the at least two of the plurality of plates.

In an embodiment of the first aspect, the strip feedline protrudes apertures on the plurality of plates.

In an embodiment of the first aspect, the combination of the plurality of plates, the ground plane and the strip feedline is arranged to operate as a waveguide resonator antenna.

In an embodiment of the first aspect, the waveguide resonator antenna is arranged to operate in a microwave frequency range.

In an embodiment of the first aspect, a second resonant frequency of one of the at least two electromagnetic signals is determined by a height of the plurality of the plates.

In an embodiment of the first aspect, the ground plane and the plurality of plates are monolithically integrated.

In an embodiment of the first aspect, the ground plane and the plurality of plates are fabricated from a unify block of metal.

In an embodiment of the first aspect, the unify block of metal includes aluminum.

BRIEF DESCRIPTION OF THE DRAWINGS

Embodiments of the present invention will now be described, by way of example, with reference to the accompanying drawings in which.

DETAILED DESCRIPTION OF THE PREFERRED EMBODIMENT

The inventors have, through their own research, trials and experiments, devised that in designing a dual-frequency antenna, the lower and higher frequency parts may be individually designed and then combined together either horizontally or vertically. This approach is straightforward at the expense of increasing the overall antenna size. Alternatively, antenna may be designed to consist of a set of antenna plates which may operate with different resonant frequencies so as to minimize the size of the antenna.

Figure 1:
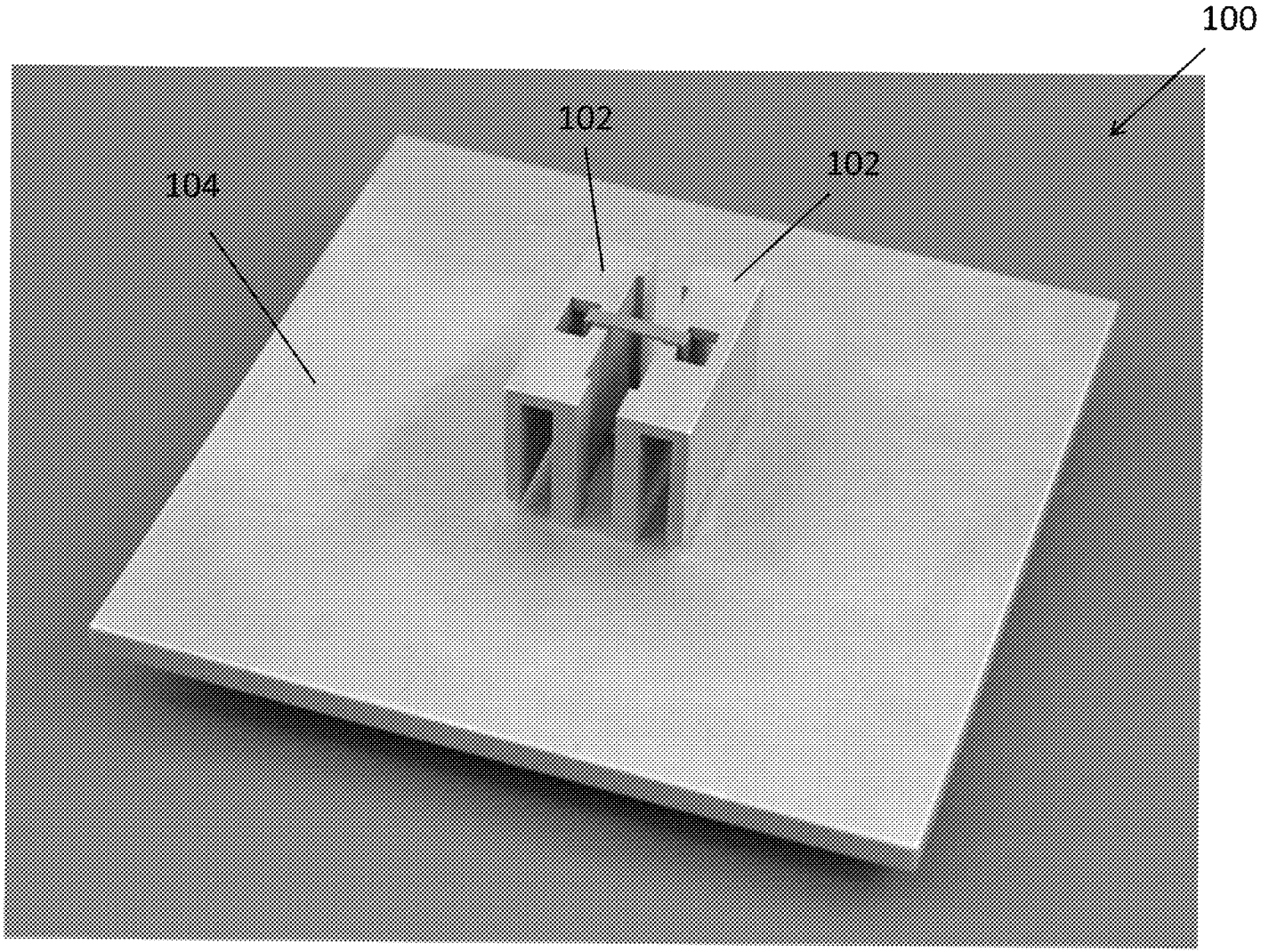
FIG. 1 is a perspective view of an antenna in accordance with one embodiment of the present invention.

With reference to FIG. 1, there is shown an embodiment of an antenna 100 for use in a communication system comprising: a plurality of plates 102 connected to a ground plane 104, wherein when the plurality of plates 102 are excited by at least two electrical signals, the plurality of plates 102 are arranged to radiate at least two electromagnetic signals each having an independent resonant frequency.

In this embodiment, the antenna 100 may operate as a Fabry-Perot resonator antenna (FRPA) and a waveguide resonator antenna (WRA), by receiving electrical signals via antenna ports 106, preferably via two separate ports 106 connected to the antenna 100. Preferably, the FPRA is arranged to operate in a millimeter-wave frequency range and the WRA is arranged to operate in a microwave frequency range, such that the antenna 100 may operate simultaneous at a millimeter-wave frequency and a microwave frequency.

Figure 2B:
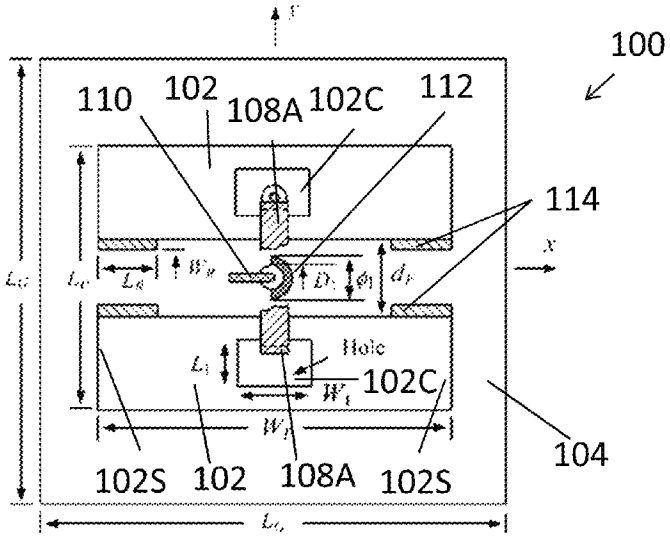
FIG. 2B is a top view of the antenna of FIG. 2A.
Figure 2A:
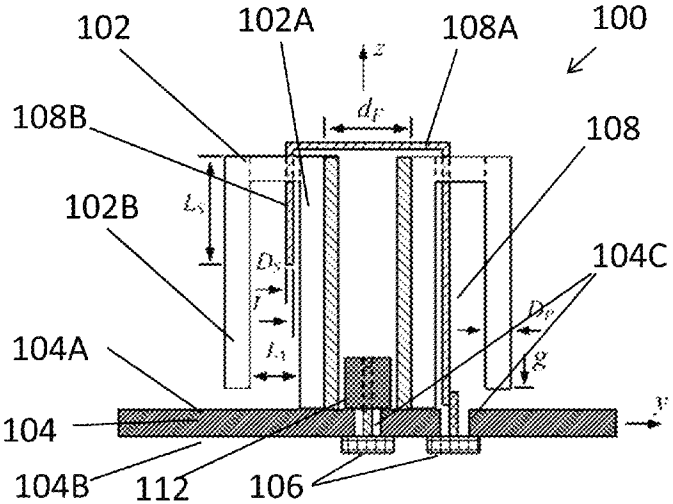
FIG. 2A is a front view of the antenna of FIG. 1.
Figure 2C:
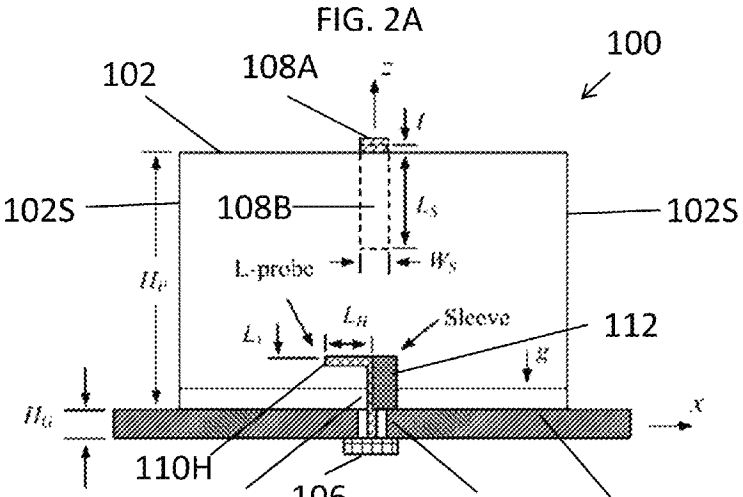
FIG. 2C is a side view of the antenna of FIG. 2A.

With reference to FIGS. 2A to 2C, in this embodiment, the antenna 100 comprises two plates 102 connected to a ground plane 104. The plates 102 are positioned parallel to each other and are perpendicular to the ground plane 104. Antenna ports 106 are provided on the ground plane 104 opposite to the surface 104A with the parallel plates 102 and are arranged to electromagnetically couples to the plates 102 via additional antenna feeders such as a strip feedline 108 or a probe feeder 110, such that the parallel plates 102 may receive one or more electrical signals from one or more of the two (or any other suitable number in some other example embodiments) antenna ports 106 when the ports 106 are connected to a signal transmitter or generator (not shown). In response to receiving the electrical signals from the ports 106, i.e. fed by the antenna feeders (108, 110) and excited by the electrical signals, the parallel plates 102 are arranged to radiate an electromagnetic signal associated with each of the electrical signals received from the antenna ports 106. Preferably, the ground plane 104 is a square ground plane 104 with a side length of $L_G$, and is provided with apertures through the opposite surfaces such that the antenna ports 106 on one side may be connected to other components (such as the feeders) of the antenna 100 on the opposite side 104B. Alternatively, the ground plane 104 may also be of any shape.

In one example embodiment, the plates 102 are made with metal, and the ground plane 104 and the plurality of plates 102 are monolithically integrated. For example, the ground plane 104 and the plurality of plates 102 are fabricated from unify block of metal such as aluminum. This may simplify the assembling of the antenna 100 and may minimize process variations which may lead to degradation or a shift in performance of the antenna 100. An aluminum block with a volume of $L_G \times L_G \times H_P$ may be used for the fabrication of the antenna 100. Alternatively, methods such as three-dimensional printing may be used to fabricate the integrated ground plane and the plates. Alternatively, the plates and the ground plane are separately fabricated and then assembled or coupled together (physically and/or electrically) by any suitable method such as welding, soldering, or combining the components using other attachment means.

Preferably, the plurality of plates 102 includes a plurality of folded plates 102. Referring to FIGS. 2A to 2C, each of the folded plate 102 includes a first plate portion 102A connected to the ground plane 104 and a second plate portion 102B connected to the first plate portion 102A but separated from the ground plane 104 at a distance of g. The each of the plurality of plate portions 102A and 102B of each folded plate 102 is parallel to each other, such that every plate portions on the ground plane 104 are essentially parallel to each other.

In one example, all the plate portions include a width of $W_P$. The first (grounded) plate portion 102A has a height of $H_P$ and the second plate portion 102B has a height of $(H_P-g)$ and is offset (horizontally) from the grounded plate portion 102A at a distance of $L_1$. The folded plates 102 are positioned on the ground plane 104 in a back-to-back configuration opposite to each other, i.e. the first (grounded) plate portion 102A of a first folded plate 102 are facing the grounded plate portion 102A of a second folded plate 102 on the same ground plane 104, and the folded plates 102 are separated by a predetermined separation $d_F$ on the ground plane 104.

The predetermined separation $d_F$ between the parallel plates 102 determines the resonant frequency of the at least one of electromagnetic signals radiated by the antenna 100, preferably the of resonant frequency of the FPRA part of the antenna 100.

As mentioned above, the antenna 100 may operate as a FPRA. In this example, the antenna 100 comprises a probe feeder 110 such as an L-shape probe or an L-probe. The probe feeder 110 is arranged to feed the parallel plates 102. Preferably, the L-probe 110 includes a vertical portion (arm) 110V connected to a horizontal portion (arm) 110H with lengths of $L_V$ and $L_H$ respectively. The L-probe 110 is positioned between the grounded plates 102 and substantially at the centre of the two edges at two opposite sides 102S of the plates 102, and with the vertical portion 110V coupled to an antenna port 106 provided on the opposite surface 104B of the ground plane 104. In addition, the horizontal arm 110H is aligned with an axis substantially parallel to the parallel plates 102 on the ground plane 104.

A crosspolarized field is mainly caused by a current on the vertical arm of the L-probe 110, and it could be suppressed by introducing a current which is opposite to that on the L-probe 110. Preferably, the antenna 100 further comprises a half-ring sleeve 112 coupled to the probe feeder 110, wherein the inner diameter of the sleeve 112 is the same as that of the aperture 104C where the L-probe 110 protrudes.

Optionally, the antenna 100 further comprises a plurality of ridges 114 positioned at the sides 102S of the plurality of plates 102, and the ridges 114 are arranged to suppress a side lobe of the electromagnetic signals. For example, as shown in FIG. 2B, a pair of ridges of size $L_R \times W_R$ are fabricated at each side opening, for suppressing the side lobes of the FPRA. These ridges have negligible effects on the WRA.

The antenna 100 may also operate as a waveguide resonator antenna arranged to operate in a frequency range or resonant frequency which is independent to the operation frequency of the FPRA, such as a frequency in a microwave frequency range. With reference to FIGS. 2A to 2C, the antenna 100 further comprises a strip feedline 108 arranged to feed the plurality of plates 102. In this example, the strip feedline 108 is in a hook-shape and includes a horizontal arm portion 108A and an open stub portion 108B. The strip feedline 108 in electrically coupled to an antenna 100 port at one end and the open stub portion 108B is hanging above from the ground plane 104 by the horizontal arm portion 108A connected between the two vertical portions. Preferably the horizontal arm portion 108A is positioned on top of or above the plurality plates 102, and the strip feedline 108 traverses across the thickness of the plates 102 as well as the distance $d_F$ between the plates 102. As shown in FIG. 2B, apertures 102C are provided on the plates 102 and the hook-strip feedline 108 may protrude these apertures 102C provided on the folded plates 102.

In the WRA structure, the plate 102 height $H_P$ was arbitrarily chosen as $0.163\lambda_0$, where $\lambda_0$ is the resonance wavelength of the WRA. As such, the resonant frequency of one of the electromagnetic signals is determined by the height $H_P$ of the plates 102. In this example, the excitation hook-strip 108 protrudes from the ground plane 104 and wraps around the two folded plates 102. To let the hook-strip 108 pass through the horizontal parts of the folded plates 102, a rectangular hole 102C of size $L_1 \times W_1$ is fabricated at the top of each folded plate 102 as shown in FIG. 2B. By varying the strip width $W_S$ and the hook-strip offset t from the grounded vertical plate 102, a 50-Ω hook-strip feedline can be obtained. By adjusting the lengths of the horizontal arm 108A and open stub 108B of the hook-strip 108, it is very easy to match the WRA.

Figure 3B:
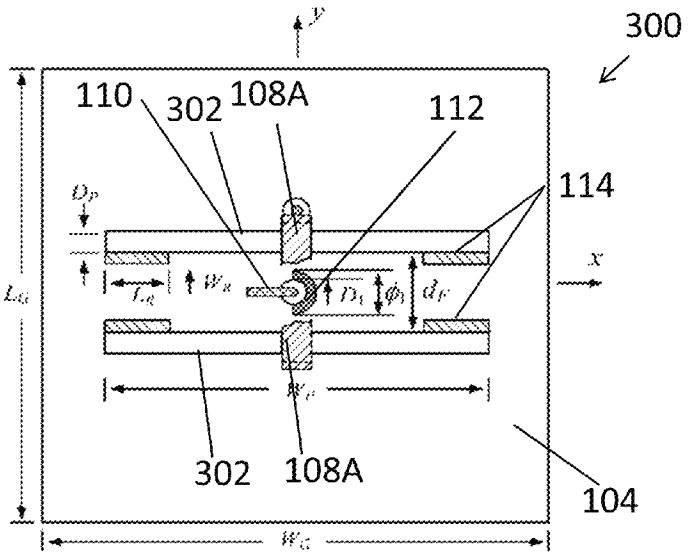
FIG. 3B is a top view of the antenna of FIG. 3A.
Figure 3A:
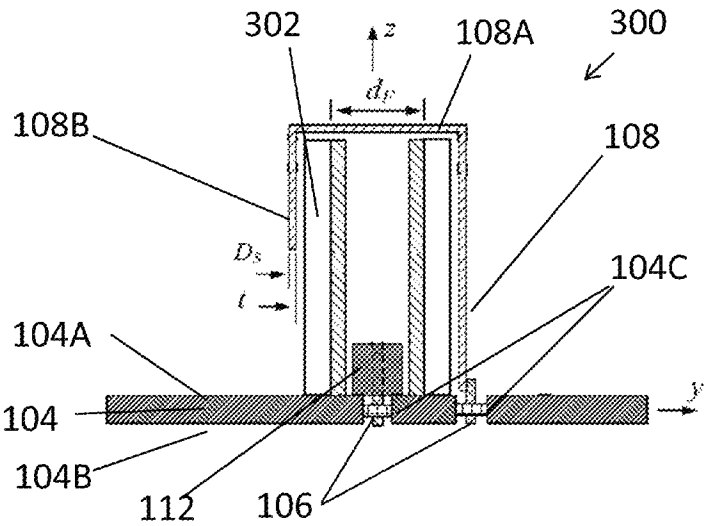
FIG. 3A is a front view of an antenna in accordance with one embodiment of the present invention.
Figure 3C:
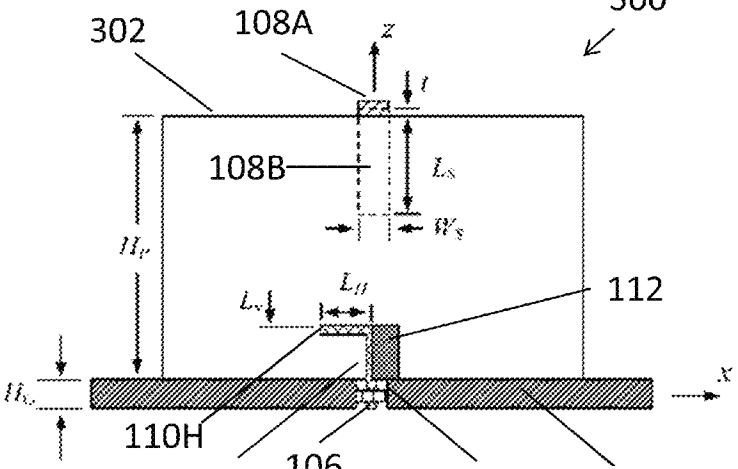
FIG. 3C is a side view of the antenna of FIG. 3A.

With reference to FIGS. 3A to 3C, there is shown another embodiment of antenna 300 comprising an antenna 100 for use in a communication system comprising: a plurality of plates 302 connected to a ground plane 104, wherein when the plurality of plates 302 are excited by at least two electrical signals, the plurality of plates 302 are arranged to radiate at least two electromagnetic signals each having an independent resonant frequency.

In this embodiment, the ground plane 104, the feeders 108, 110 and the ports 106 are substantially the same as the previous embodiment as shown in FIGS. 2A to 2C, except that the folded plates 102 are replaced by straight plates 302. The hook-strip wrap around a pair of adjacent plates 302 without having to protrude any apertures on the plates. Similarly, the parallel plates 302 and the ground plane 104 may be advantageously integrated by fabricating with a unitary block of aluminum or other suitable materials.

These embodiments are advantageous in that a new compact dual-frequency antenna 100 with a large frequency ratio is provided, which consists of a pair of folded parallel plates. It integrates the microwave parallel-plate waveguide resonator antenna 100 (WRA) with the millimeter-wave Fabry-Perot resonator antenna 100 (FPRA), with their resonant frequencies being independent of each other. Due to the folded structure, the profile of the proposed antenna 100 is lower than that of the conventional parallel plate waveguide resonator antenna 100. The WRA part is excited by a hook-shaped strip on its top, whereas the FPRA is excited by an L-probe with a half-ring sleeve. The WRA and the FPRA share the same ground plane.

The dual-frequency antenna 100 may be fabricated by using a pair of folded parallel plates, compactly integrating the microwave WRA with the millimeter-wave FPRA. Advantageously, the use of folded parallel plates decreases the profile of the proposed dual-frequency antenna 100.

The resonant frequency of the WRA and FPRA are determined by the plate height and the distance between of the folded parallel plates, respectively, which makes it very easy to obtain a large frequency ratio.

In an example embodiment as discussed earlier, the antenna 100 may be made from a single aluminum block. Therefore, no soldering is needed to connect the folded parallel plates and ground plane.

The WRA of the antenna 100 is simply fed by a hook-strip, which protrudes from the ground plane and wraps around the two folded plates. It is very easy to match the WRA by adjusting the lengths of the horizontal arm and open stub of the hook-strip.

The FPRA is excited by an L-probe with a half-ring sleeve. The half-ring sleeve can provide a vertical current which is opposite to that on the vertical arm of the L-probe. Due to the cancellation of the two vertical currents, the crosspolarized field of the FPRA can be desirably suppressed.

In one example embodiment, a dual-frequency antenna 100 that covers the 2.4-GHz and 24-GHz ISM bands was designed using ANSYS HFSS and fabricated. The detailed dimensions are given by $L_G$=100 mm, $H_G$=4 mm, $W_P$=30 mm, $L_P$=22.7 mm, $H_P$=20 mm, $D_P$=2 mm, $L_R$=5 mm, $W_R$=1 mm, $L_1$=4 mm, $W_1$=6.5 mm, $L_S$=7.5 mm, $W_S$=2.33 mm, $D_S$=0.5 mm, $L_H$=3 mm, $L_V$=2.8 mm, $D_1$=2 mm, $Ø_1$=6 mm, $d_F$=6.7 mm, t=0.5 mm, and g=1.6 mm.

The measurement was divided into the microwave and millimeter-wave parts. In the former, the S-parameters were measured with an Agilent E5071C network analyzer, whereas the radiation pattern, realized gain, and the antenna 100 efficiency were measured by a Satimo StarLab system. For the millimeter-wave part, the S-parameters were measured using an E8361A network analyzer, and the radiation pattern and realized gain were measured with an NSI measurement system. Since the antenna 100 efficiency cannot be directly measured by the NSI system, the antenna 100 efficiency of the FPRA is calculated from the ratio between its measured realized gain and directivity.

Figure 4B:
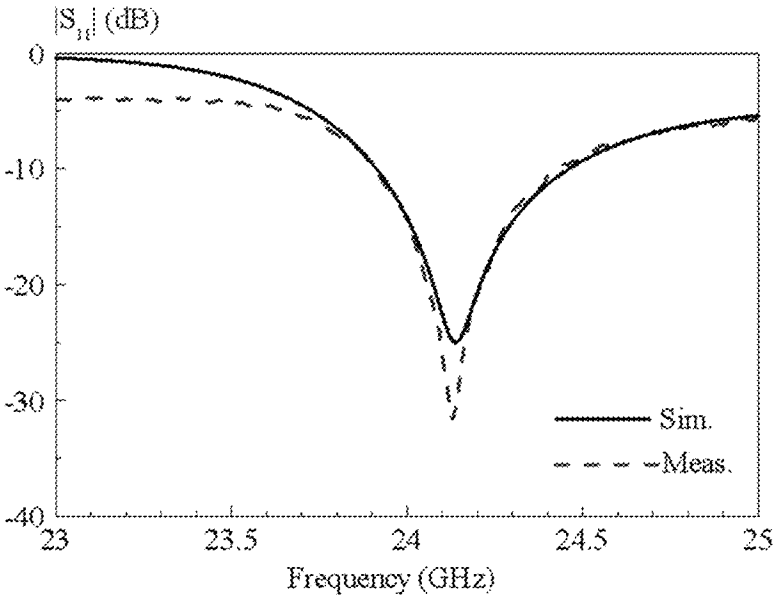
FIG. 4B is a plot showing measured and simulated reflection coefficients of the FPRA of the antenna of FIG. 1.
Figure 4A:
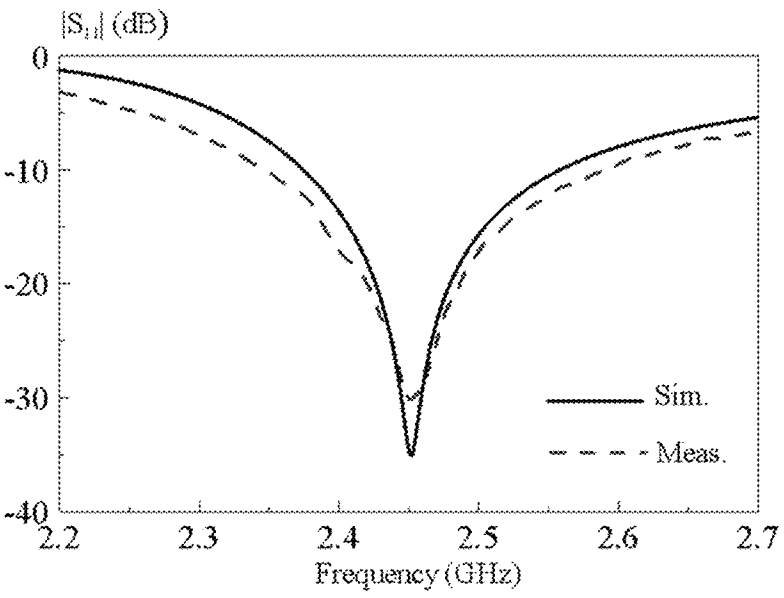
FIG. 4A is a plot showing measured and simulated reflection coefficients of the WRA of the antenna of FIG. 1.

With reference to FIGS. 4A and 4B, which show the measured and simulated reflection coefficients of the proposed dual-frequency antenna 100, with reasonable agreement between them. It is show the measured and simulated impedance bandwidths ($|S_{11}|<-10$ dB) of the WRA, which are given by 9.7% (2.35-2.59 GHz) and 7.3% (2.37-2.55 GHz), respectively. The difference between them is caused by experimental tolerances. With reference to FIG. 4B, the measured and simulated impedance bandwidths of the FPRA are 2.11% (23.91-24.42 GHz) and 2.23% (23.92-24.46 GHz), respectively. This bandwidth is similar to that of some other FPRA.

Figure 5A:
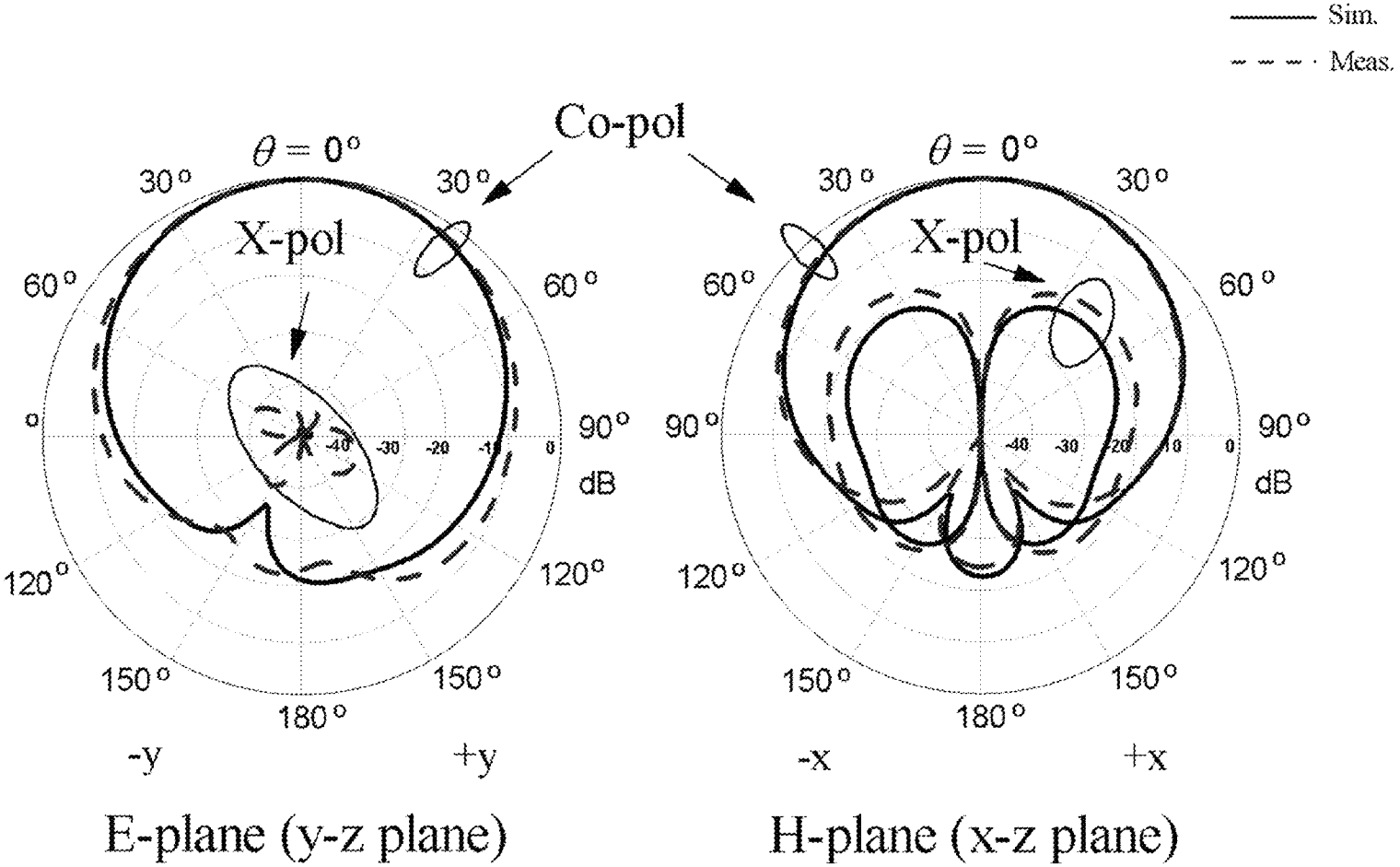
FIG. 5A is a plot showing measured and simulated radiation patterns of the WRA of the antenna of FIG. 1.
Figure 5B:
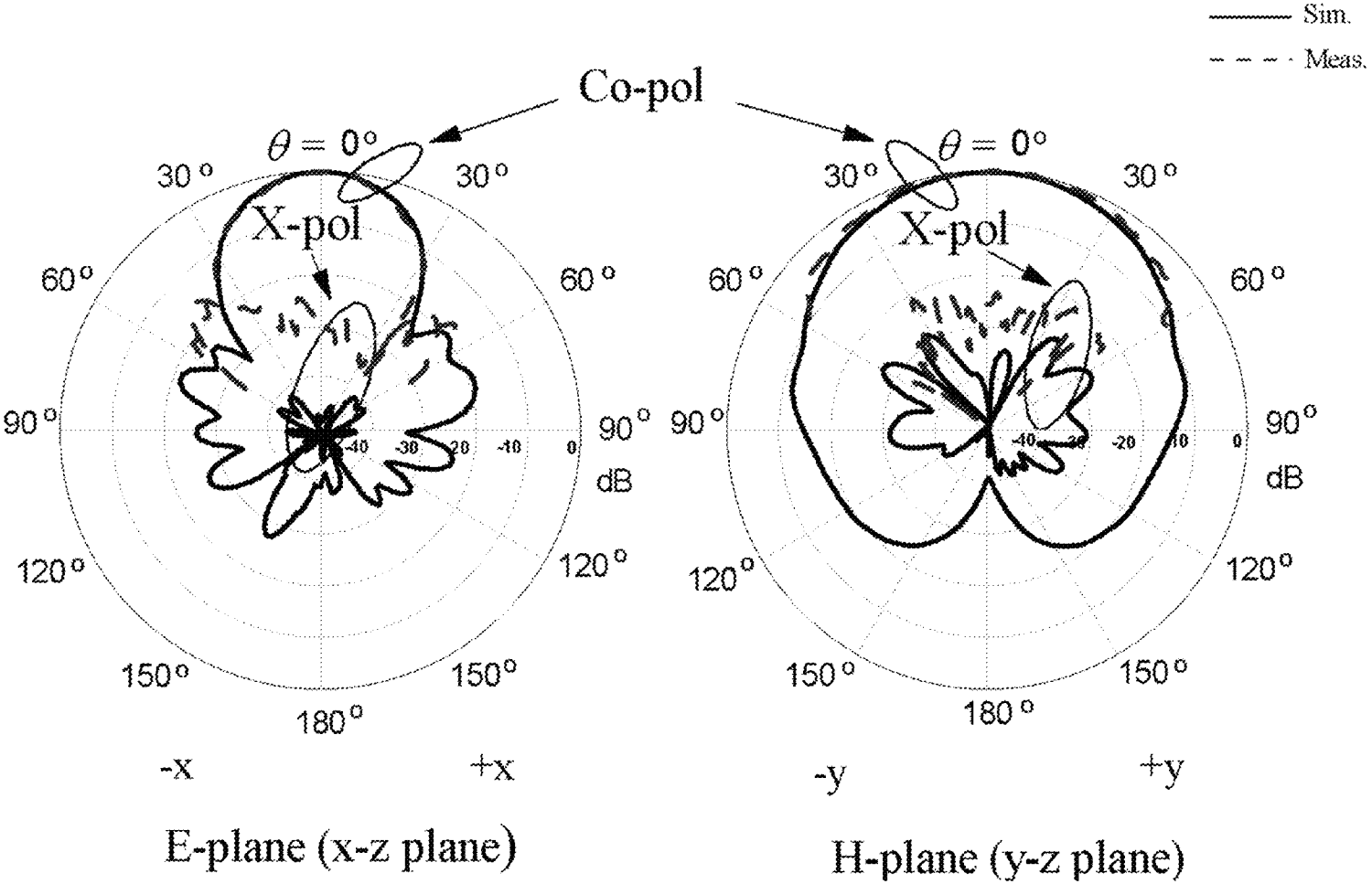
FIG. 5B is a plot showing measured and simulated radiation patterns of the FPRA of the antenna of FIG. 1.

With reference to FIGS. 5A and 5B, there is shown the measured and simulated radiation patterns of the dual-frequency antenna 100. As can be observed from the figure, broadside radiation patterns are obtained for both the WRA (FIG. 5A) and FPRA (FIG. 5B) parts, as expected. For each part, the measured and simulated crosspolarized fields are weaker than their copolarized counterparts by at least 25 dB in the boresight direction (θ=0).

Figure 6B:
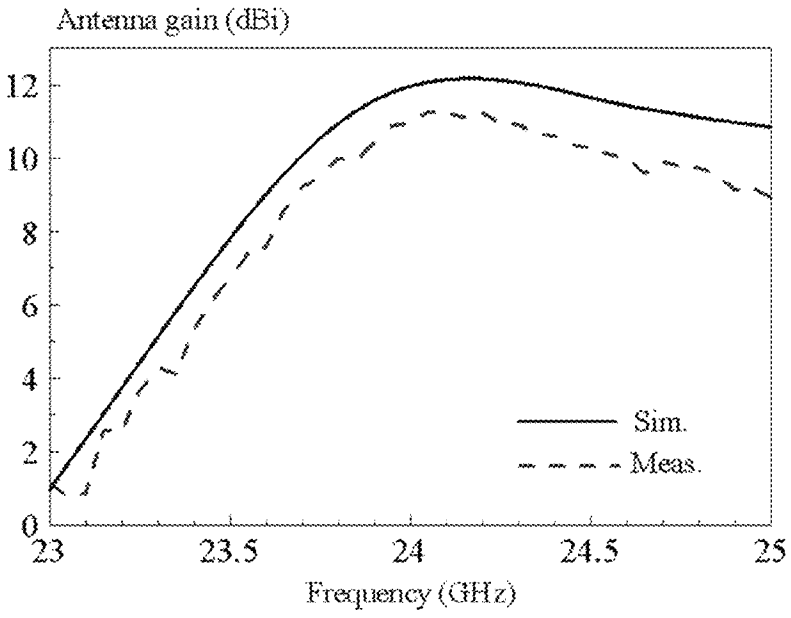
FIG. 6B is a plot showing measured and simulated antenna gains of the FPRA of the antenna of FIG. 1.
Figure 6A:
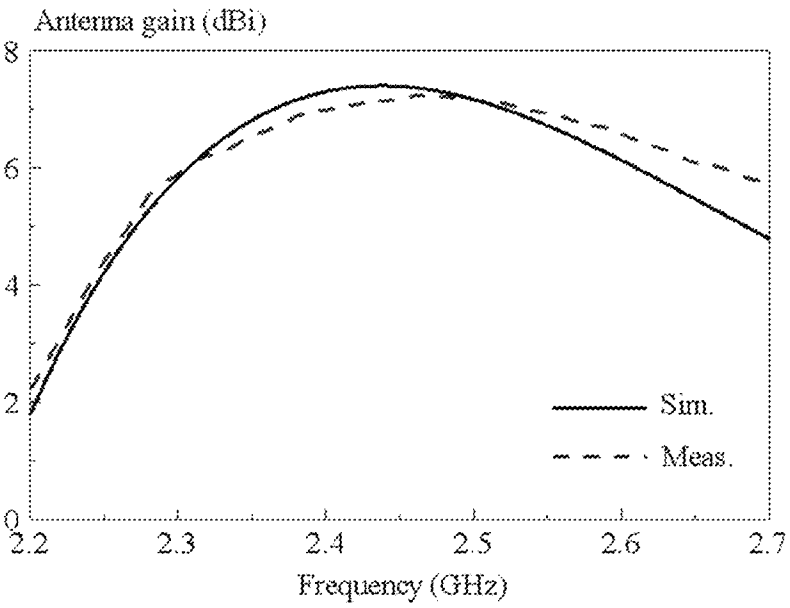
FIG. 6A is a plot showing measured and simulated antenna gains of the WRA of the antenna of FIG. 1.

With reference to FIGS. 6A and 6B, there is shown the measured and simulated realized gains of the dual-frequency antenna 100 in the boresight direction (θ=0°). Again, reasonable agreement between the measured and simulated results is obtained for both the FPRA and WRA parts. With reference to FIG. 6A, the measured and simulated peak gains of the WRA are 7.23 dBi (2.46 GHz) and 7.40 dBi (2.44 GHz), respectively. It is shown in FIG. 6B the peak gain of the FPRA. As can be observed from the figure, the measured and simulated peak gains are 11.26 dBi (24.05

GHz) and 12.16 dBi (24.15 GHz), respectively. This gain value is similar to that of the some other FPRA. The results show that the FPRA part is not affected by the WRA part.

Figure 7B:
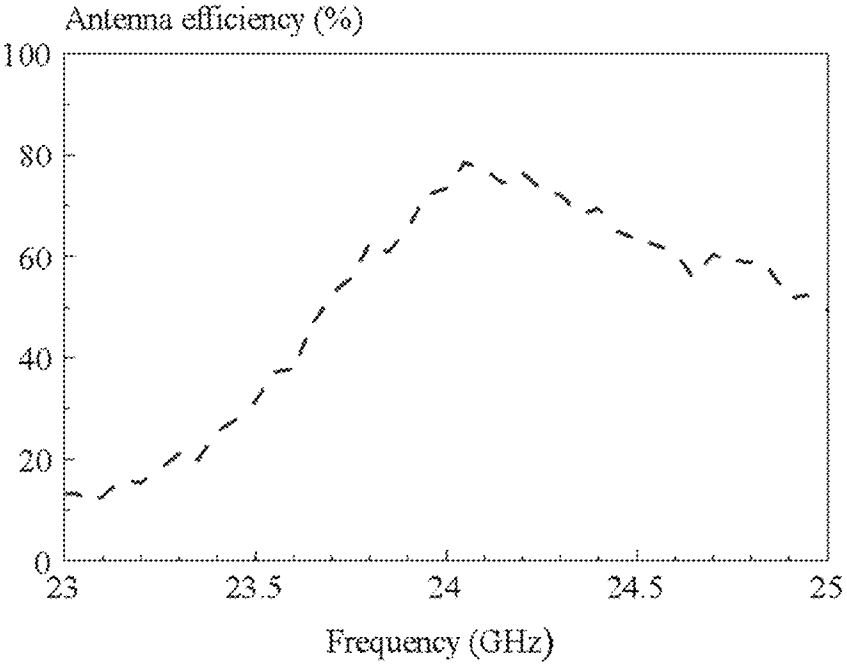
FIG. 7B is a plot showing measured antenna efficiencies of the FPRA of the antenna of FIG. 1.
Figure 7A:
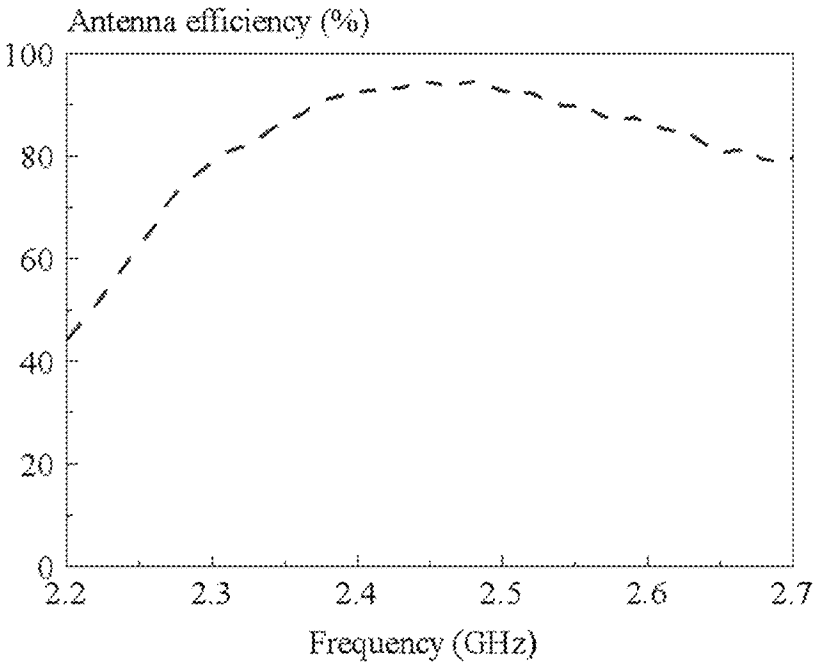
FIG. 7A is a plot showing measured antenna efficiencies of the WRA of the antenna of FIG. 1.

With reference to FIGS. 7A and 7B, there is shown the measured antenna 100 efficiency of the dual-frequency antenna 100. Referring to FIG. 7A, the maximum efficiency of 95% of the WRA is found at 2.48 GHz, showing that the WRA part is a very efficient antenna 100. The calculated antenna 100 efficiency of the FPRA is shown in FIG. 7B. As can be observed from the figure, the highest antenna 100 efficiency is 78.5% at 24.05 GHz, which is lower than that (95%) of the WRA. It is acceptable when considering the much higher operating frequency of the FPRA.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

Any reference to prior art contained herein is not to be taken as an admission that the information is common general knowledge, unless otherwise indicated.

The invention claimed is:

1. An antenna for use in a communication system comprising:

a plurality of plates connected to a ground plane, wherein the plurality of plates includes plates that are parallel to each other, and when the plurality of plates are excited by at least two electrical signals, the plurality of plates are arranged to radiate at least two electromagnetic signals each having an independent resonant frequency; and a probe feeder and a strip feedline both arranged to feed the plurality of plates;

wherein the combination of the plurality of plates, the ground plane and the probe feeder is arranged to operate as a Fabry-Perot resonator antenna; and wherein the combination of the plurality of plates, the ground plane and the strip feedline is arranged to operate as a waveguide resonator antenna.

2. The antenna of claim 1, wherein the plurality of plates include a plurality of folded plates.

3. The antenna of claim 2, wherein each of the plurality of folded plates includes a plurality of plate portions, wherein each of the plurality of plate portions is parallel to each other.

4. The antenna of claim 3, wherein each of the plurality of folded plates is positioned on the ground plane in a back-to-back configuration.

5. The antenna of claim 1, wherein the plurality of plates include a plurality of straight plates.

6. The antenna of claim 1, wherein the plurality of plates are positioned on the ground plane with a predetermined separation between each pair of the plurality of plates.

7. The antenna of claim 6, wherein a first resonant frequency of one of the at least two electromagnetic signals is determined by the predetermined separation.

8. The antenna of claim 1, wherein the probe feeder is in an L-shape and includes a vertical portion connected to a horizontal portion.

9. The antenna of claim 1, wherein the probe feeder is positioned between a pair of the plurality of plates.

10. The antenna of claim 1, further comprising a half-ring sleeve coupled to the probe feeder.

11. The antenna of claim 10, wherein the half-ring sleeve is arranged to suppress a crosspolarized field within the plurality of plates.

12. The antenna of claim 1, wherein the Fabry-Perot resonator antenna is arranged to operate in a millimeter-wave frequency range.

13. The antenna of claim 1, further comprising a plurality of ridges positioned at the sides of the plurality of plates.

14. The antenna of claim 13, wherein the plurality of ridges are arranged to suppress a side lobe of one of the at least two electromagnetic signals radiating from the Fabry-Perot resonator antenna.

15. The antenna of claim 1, wherein the strip feedline is in a hook-shape and includes a horizontal arm portion and an open stub portion.

16. The antenna of claim 15, wherein the strip feedline traverses across the thickness of at least two of the plurality of plates and a distance between the at least two of the plurality of plates.

17. The antenna of claim 15, wherein the strip feedline protrudes apertures on the plurality of plates.

18. The antenna of claim 1, wherein the waveguide resonator antenna is arranged to operate in a microwave frequency range.

19. The antenna of claim 1, wherein a second resonant frequency of one of the at least two electromagnetic signals is determined by a height of the plurality of the plates.

20. The antenna of claim 1, wherein the ground plane and the plurality of plates are monolithically integrated.

21. The antenna of claim 20, wherein the ground plane and the plurality of plates are fabricated from a unified block of metal.

22. The antenna of claim 21, wherein the unified block of metal includes aluminum.

* * * * *